United States Patent [19]

Pastore

[11] Patent Number: 4,970,747

[45] Date of Patent: Nov. 20, 1990

[54] TRASH RACK CLEANING APPARATUS

[76] Inventor: Joseph Pastore, 250 Foreside Rd., Cumberland, Me. 04110

[21] Appl. No.: 349,514

[22] Filed: May 9, 1989

[51] Int. Cl.[5] ..... A46B 13/02

[52] U.S. Cl. ..... 15/88.4; 15/179; 210/396

[58] Field of Search ..... 15/21 E, 83, 53 AB, 15/50 C, 179, 181, 183, 23, 77, 93 R; 210/391, 396

[56] References Cited

U.S. PATENT DOCUMENTS

| | | | |
|---|---|---|---|
| 3,113,332 | 12/1963 | Kasper | 15/83 X |
| 3,500,487 | 3/1970 | Capra | 15/53 AB |
| 3,593,358 | 7/1971 | Hofmann | 15/53 AB |
| 3,755,846 | 9/1973 | Sandler | 15/93 R |

FOREIGN PATENT DOCUMENTS

| | | | |
|---|---|---|---|
| 2542781 | 9/1984 | France | 15/93 R |

*Primary Examiner*—Edward L. Roberts
*Attorney, Agent, or Firm*—Thomas L. Bohan

[57] ABSTRACT

A cleaning apparatus for cleaning under water structures that comprises a cylindrical brush having a plurality of bristles that extend radially outward, a sealed electric motor for axially rotating the cylindrical brush and a winch and cables to raise and lower the cylindrical brush as it cleans the under water structure. A substantially rectangular trough is displaced below the cleaning apparatus to collect debris that is removed from the underwater structure as the structure is being cleaned.

5 Claims, 1 Drawing Sheet

TRASH RACK CLEANING APPARATUS

BACKGROUND OF THE INVENTION

1. Technical Field

This invention relates to apparatus for cleaning underwater structures and in particular to the removal of debris collecting on trash racks.

2. Background Art

Power generating systems, be they fossil-fueled, nuclear-based, or hydro-electric, are dependent on a non-interruptable source of water. In general, the water intake requirements for public utilities and private factories can amount to thousands of gallons per minute. Depending on the application, the demand for water may vary between the maximum intake possible to almost no water at all within a short period of time. Usually such intake water is drawn from some type of open reservoir, e.g., lakes, rivers or the ocean. Due to the high flow rates of the water drawn in for this purpose, water intake systems have long been plagued by problems of trash and marine life entrainment. As an initial filtration to eliminate trash, large gratings are often placed at the point where water first enters the system. The purpose of these initial filters or trash racks is to allow the free flow of water while at the same time intercepting the larger components of water-borne debris. Because such trash racks tend to become clogged with debris it is necessary to clean the surface of the racks in order to remove the debris and marine matter which impede the flow of water.

To alleviate the arduous task of periodically pulling the trash racks out of the water for maintenance, there has been a great deal of effort devoted to cleaning the racks while they are submerged. This in situ cleaning usually involves various juryrigged scrapers that are hauled across the trash racks from above. These scraping techniques tend to damage the racks' protective paint covering, hastening the need for a complete removal of the trash rack and re-painting. The need to repaint is especially critical where the racks are immersed in sea water.

Currently the trash rack cleaning involves a metal rake or comb which is hauled or pushed, with the help of a crane, over the trash rack structure. U.S. Pat. No. 3,755,864 issued to Sandler (1973) discloses a method of cleaning trash racks that uses rakes mounted on a circular track. The teeth of the rake as disclosed in the Sandler patent are continually swept along the longitudinal length of the rack to be cleaned. The problem with this method is that the mechanism necessary to drive the rakes in such a system is complex and difficult to move from one rack to another. Another currently-available method of cleaning trash racks involves hydraulic mechanisms that move a rake over the length of the trash rack. This method, too, involves the use of heavy expensive equipment that is difficult to move laterally from one rack to another.

What is needed is a relatively light and transportable cleaning apparatus that will not damage the surface of the underwater structure that is to be cleaned. It is the object of this invention to implement an easy-to-use and maneuverable cleaning system for underwater trash racks.

SUMMARY OF THE INVENTION

The present invention comprises a device that will clean and remove unwanted materials from underwater structures. It utilizes a sealed cylindrical motor onto which a plurality of curved plates are fixed in order to form a rotating brush. Each curved plate has a plurality of bristles located thereon that are used to clean the rack when the brush is turned about its axis. Below the cylindrical brush is a container to catch the debris that is removed from the rack as it is being cleaned. The sealed motor and cleaning brush form a single cylindrical assembly that can be raised or lowered to clean the underwater structure. Apart from an electrical cord that supplies power to the sealed motor, the only other equipment needed are cables to raise or lower the sealed motor and cleaning brush assembly.

DETAILED DESCRIPTION OF INVENTION

Figure 1:
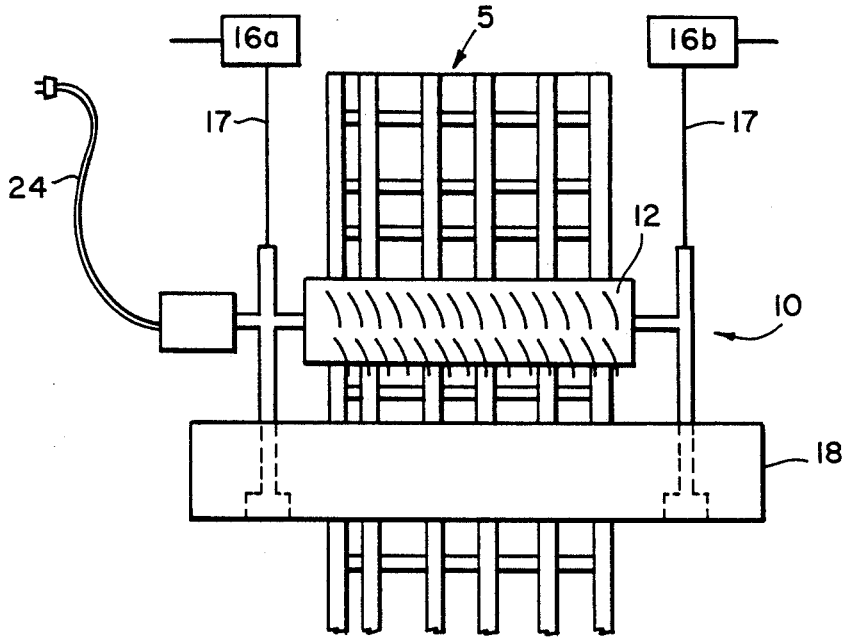
FIG. 1 is a view showing the trash rack cleaning apparatus in position to clean a submerged trash rack.

FIG. 1 shows a cleaning apparatus assembly in position to remove debris from a trash rack 5. The cleaning apparatus shown generally at 10 consists of a cylindrical brush 12 comprising a plurality of bristles 14. Below said cylindrical brush 12 and attached thereto is a trough 18 used to collect the debris that is dislodged by said cleaning apparatus 10. As said cleaning apparatus 10 is used, the top of said cylindrical brush 12 is rotated away from said trash rack 5 to be cleaned. As said cylindrical brush 12 is rotated, said bristles 14 pull said cleaning apparatus 10 downward and against said trash rack 5, thus tending to increase the scrubbing power of said bristles 14. Said cylindrical brush 12 is suspended from above by means of winches 16A and 16B and cables 17. Said winches 16A and 16B can be either hand-cranked or electrically driven.

Figure 2:
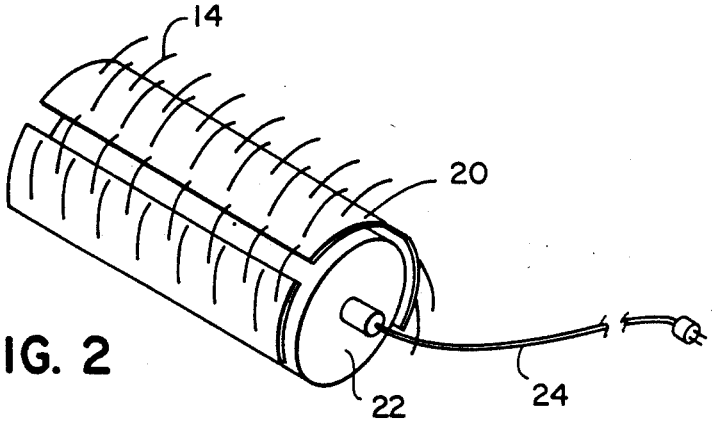
FIG. 2 is a view depicting the curved plates that make up the cylindrical brush and the cylindrical motor housing on which the curved plates are mounted.

FIG. 2 shows a cylindrical electric motor 22 upon which said cylindrical brush 12 is mounted. Said cylindrical electric motor 22 is sealed so as to be operable while submerged underwater. Attached to the outer surface of said cylindrical electric motor 22, are a plurality of curved plates 20. Each of said curved plates 20 has substantially the same radius of curvature as does said cylindrical electric motor 22 to which said curved plates 20 are mounted. Each of said curved plates 20 is mounted on said cylindrical electric motor 22 by a non-water soluble adhesive or by sheet metal screws. A power cord 24 supplies electric current to said cylindrical electric motor 22.

Figure 3:
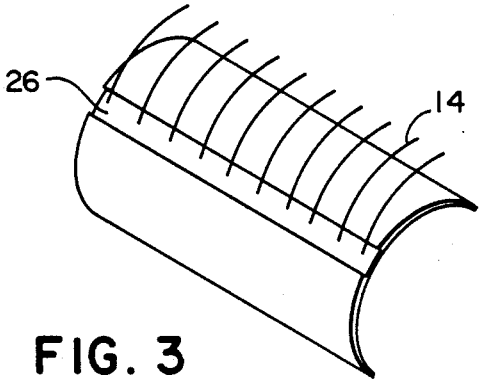
FIG. 3 shows a detailed view of a curved plate and how the bristles are attached.

FIG. 3 shows a detailed view of one said curved plates 20. Each of said curved plates has a slot 26 into which a row of said bristles 14 can be inserted and fixed to one of said curved plates.

The cleaning apparatus 10 has the advantage of being relatively lightweight and maneuverable. Because said cylindrical brush 12 is rotated by said co-axial cylindrical electric motor 22, it is not necessary to provide a complicated driving mechanism to turn the brush from above the water. Due to the lack of complicated driving mechanism, the cleaning apparatus 10 has the advantage of being easily movable from one trash rack to another.

Although the present invention has been described with reference to the preferred embodiment, workers skilled in the art will recognize that changes may be made in form and detail without departing from the spirit and scope of the invention.

I claim:

1. Apparatus for removing debris from an underwater trash rack, comprising:

a. a cylindrical brush having a plurality of bristles extending radially outward, b. a sealed cylindrical motor for rotating said cylindrical brush, wherein said cylindrical brush is affixed to said sealed cylindrical motor, c. means for raising and lowering said cylindrical brush, and d. a trough attached to said means for raising and lowering said cylindrical brush wherein said trough is suspended below said cylindrical brush.

2. Apparatus as claimed in claim 1 wherein said cylindrical brush comprises a plurality of curved plates, wherein each of said plurality of curved plates is mounted on the outside of said sealed cylindrical motor and wherein each of said plurality of curved plates comprises said plurality of bristles extending therefrom.

3. Apparatus as claimed in claim 1 wherein said sealed cylindrical motor is a cylindrical electric motor.

4. Apparatus as claimed in claim 1 wherein said trough is substantially rectangular, having a length that is substantially the same as the length of said cylindrical brush.

5. Apparatus for removing debris from an underwater trash rack comprising:

(a) a cylindrical brush formed from a plurality of curved plates, each of said curved plates having a plurality of bristles that extend radially outward from said curved plate, (b) a cylindrical electric motor to rotate said cylindrical brush, wherein said curved plates are affixed to the outside surface of said cylindrical motor, (c) winch means for raising and lowering said cylindrical brush, and (d) a substantially rectangular trough that is suspended below said cylindrical brush for collecting debris removed from said underwater trash rack as it is being cleaned.

* * * * *